United States Patent [19]

Kock et al.

[11] Patent Number: 4,733,859

[45] Date of Patent: Mar. 29, 1988

[54] EXERCISE APPARATUS

[75] Inventors: Ronald W. Kock, Wyoming; Charles E. Schuster, Fairfield, both of Ohio

[73] Assignee: Bio-Mechanisms, Inc., Fairfield, Ohio

[21] Appl. No.: 917,660

[22] Filed: Oct. 9, 1986

[51] Int. Cl.[4] ..... A63B 23/04

[52] U.S. Cl. ..... 272/96; 272/130; 118/25 B

[58] Field of Search ..... 272/93, 96, 94, 130–132, 272/134, 146, 70; 128/25 R, 25 B, 80 R

[56] References Cited

U.S. PATENT DOCUMENTS

| | | | |
|---|---|---|---|
| Re. 23,744 | 11/1953 | Magida . | |
| D. 189,011 | 10/1960 | Berne . | |
| 3,103,357 | 9/1963 | Berne . | |
| 3,717,338 | 2/1973 | Hughes . | |
| 3,929,331 | 12/1975 | Beeding . | |
| 4,036,714 | 7/1977 | Loomis et al. | 272/96 |
| 4,066,259 | 1/1978 | Brentham | 272/130 |
| 4,159,111 | 6/1979 | Lowth . | |
| 4,186,920 | 2/1980 | Flore et al. . | |
| 4,240,627 | 12/1980 | Brentham | 272/130 |
| 4,252,447 | 6/1981 | Lepley et al. | 272/96 |
| 4,278,249 | 7/1981 | Forrest | 272/132 X |
| 4,374,588 | 2/1983 | Ruggles . | |
| 4,408,759 | 10/1983 | Reneau et al. . | |
| 4,502,681 | 3/1985 | Blomqvist . | |
| 4,570,925 | 2/1986 | Kock et al. | 272/131 X |
| 4,605,220 | 8/1986 | Troxel . | |
| 4,650,183 | 3/1987 | McIntyre | 272/96 |

OTHER PUBLICATIONS

The Total Knee Developer and The Total Neck Developer, World Sporting Goods, Inc., "Athletic Journal", May, 1979.

*Primary Examiner*—Alfred C. Perham
*Assistant Examiner*—Richard E. Chilcot, Jr.
*Attorney, Agent, or Firm*—John J. Ryberg

[57] ABSTRACT

An exercise machine wherein the muscles which move a part of the body such as the foot or head are exercised by restricting movement of the body part to rotation about each of at least two mutually perpendicular axes and providing independently adjustable resistance means to selectively resist rotational movement of the body part about each axis with a desired degree of resistance which does not vary with the position or speed of movement of the body part.

28 Claims, 8 Drawing Figures

EXERCISE APPARATUS

FIELD OF THE INVENTION

The present invention relates to exercise machines of a type wherein the muscles which move a given part of the body are exercised by separately controlling rotation of the body part about each of at least two mutually perpendicular axes and causing the body part to move against resistance provided by independently adjustable resistance means associated with each axis.

BACKGROUND OF THE INVENTION

It is often desirable to exercise the skeletal muscles responsible for supporting and moving various parts of the body in order to strengthen such muscles. Exercise may be undertaken for rehabilitative purposes to restore normal strength and range of motion where muscle tissue has been weakened by disease, injury or prolonged inactivity as commonly occurs when a body part has been immobilized for an extended period in a cast or brace. In otherwise healthy individuals, exercise is beneficial for increasing vigor and maintaining an attractive appearance. For athletes or others engaging in demanding physical activity, exercise improves performance and is believed to reduce the likelihood of injury.

A skeletal muscle can exert a force effective to move a part of the body only by contracting and shortening in length. Once contracted, force must be applied in order to lengthen the muscle and restore the body part to its initial position. Hence, skeletal muscles are usually arranged around a joint in antagonistic pairs, so that when one muscle contracts, another is lengthened moving the body part in a plane of rotation about a skeletal joint. Most parts of the body, particularly the limbs, are supported and moved by more than a single antagonistic pair of skeletal muscles and are capable of motion in more than one plane. As a consequence, most external body movements can be described in terms of rotational movement about one or more axes of one or more skeletal joints. In the foot for instance, twelve muscles serve to support and move the foot about the ankle. Movement in different directions involves different muscles, some of which are naturally capable of exerting more force than others. This is due to a variety of factors including difference among muscle length and bulk and, significantly, differences in overall mechanical advantage related to the position of the muscle. For example, the muscles responsible for plantarflexion and dorsiflexion of the foot, i.e., moving the foot up and down, are stronger than the muscles which perform inversion and eversion, i.e., rotation of the foot to the inside and outside, respectively. A major shortcoming of exercise machines of the prior art is that they do not adequately accommodate differences in the forces with which a part of the body can be rotated about different axes.

For example, U.S. Pat. No. 4,186,920 to Fiore et al. shows an exerciser wherein the foot is strapped to a foot support connected to a ball and socket universal joint to permit tilting in any direction. The ball and socket joint provides adjustable frictional resistance by virtue of a two-piece socket which can be tightened against the ball to provide a desired amount of resistance. While such an apparatus allows universal rotational movement of the foot, the resistance in every direction is substantially the same. If the resistance is set sufficiently high to resist the more powerful plantarflexion/dorsiflexion movements, it will be undesirably high for inversion-/eversion movements. Conversely, if the resistance is lowered to a proper level for inversion/eversion, the exercise will be less effective for plantarflexion/dorsiflexion. This dilemma is most acute when the physical therapist or athletic trainer wishes to combine plantarflexion/dorsiflexion and inversion/eversion movement components into a single motion wherein the toes traverse an elliptical or circular path. If the resistance is set correctly for one component, it will be incorrect for the other.

Another problem with the exerciser shown in Fiore et al. is that at high resistance settings, the apparatus may tip or slide if the weight of the base is insufficient to firmly anchor the device to the floor.

U.S. Pat. No. 4,605,220 to Troxel seeks to isolate the muscles involved in plantarflexion, dorsiflexion inversion and eversion by providing four independently adjustable shock absorbers disposed to resist rotation about a pair of mutually perpendicular horizontal axes. While such an arrangement can be used to provide more resistance for dorsiflexion/plantarflexion than inversion/eversion movements which are normally less powerful, it has certain shortcomings. Shock absorbers typically operate using a compression spring or dashpot or some combination of the two. Springs as resistance generators are undesirable since the force will vary with the position of the foot as displacement of the spring changes. The degree of resistance provided by dashpot devices is speed dependent. Thus, dashpots are unsuitable where it is desired to provide a substantially constant resistance over a range of speeds.

Various types of friction devices for supplying resistance for exercising are known (see, e.g., U.S. Pat. No. 3,717,338 to Hughes). However, a problem faced by some exercise machines utilizing friction resistance means is the difficulty in obtaining smooth resistance over a wide range of resistance settings without requiring an unduly large frictional contact area. For example in the friction clutch illustrated in U.S. Pat. No. 3,103,357 to Berne, two stationary and one rotating disk are required to provide sufficient frictional contact area to supply the torque required to adequately resist bending of the knee. The smaller the frictional contact area, the greater the pressure needed between frictionally mating surfaces to produce the same resistance. Unless the properties of the frictional surfaces are carefully controlled, high pressures can cause static frictional effects to become highly apparent and sometimes dominate dynamic frictional effects. This can result in the exercise machines having an uneven or "jerky" feel, particularly during slow movements or at the beginning of motion where static frictional forces must be overcome.

Accordingly, there is a need for an exercise machine which accounts for differences in the force with which a part of the body can be rotated about different axes. Furthermore, there exists a need for such an exercise machine which provides resistance which does not vary with position or velocity. There is also a need for an exercise machine having frictional resistance means which can provide adjustable, smooth resistance over a wide range of resistance settings without requiring unduly large frictional surfaces. In addition to meeting the above needs, it is an object of the invention to provide an exercise machine having a rotatable friction plate and a non-rotatable plate carried by a common rotating shaft so that the plates are urged together by a compression spring whose length can be adjusted by rotating a jam nut threaded on the shaft and wherein the jam nut is prevented from unintentionally unthreading as the machine is used. It is a further object of the invention to provide an apparatus for exercising the muscles associated with movement of the foot wherein at least one axis of rotation of the foot can be adjusted to align with the natural angulation of the foot and which is not subject to tipping or sliding when used even at high resistance settings. These and other objects and advantages of the present invention will be more fully appreciated as the reader proceeds.

SUMMARY OF THE INVENTION

In brief, the invention provides an exercise apparatus which accounts for differences in the force with which a part of the body can be rotated about different axes by restricting movement of the body part to rotation about at least two mutually perpendicular axes and providing independently adjustable resistance means associated with each axis. The invention also provides an improved resistance means wherein a rotating friction device is coupled to the moving body part through a gear train operable to cause the friction device to rotate through a greater angle than the member driven by the body part. Because work is the product of force and distance, a given level of work can be achieved from a smaller disk by rotating the disk through a greater angle. The use of gearing which increases movement of the frictional surface avoids both need to increase the pressure between the mating frictional surfaces, as well as the need to use double or large area frictional surfaces to provide adequate resistance. The invention also provides an improved apparatus for exercising the muscles associated with movement of the foot which is prevented from tipping or sliding along the floor even when being used at high levels of resistance due to the stabilizing weight of the user seated on the apparatus. The invention further provides an improved apparatus for exercising the muscles associated with movement of the foot which includes a transversely angulatable yoke for aligning the plate supporting the foot with the natural axis of the ankle joint.

DETAILED DESCRIPTION OF THE INVENTION

First Preferred Embodiment

Figure 1:
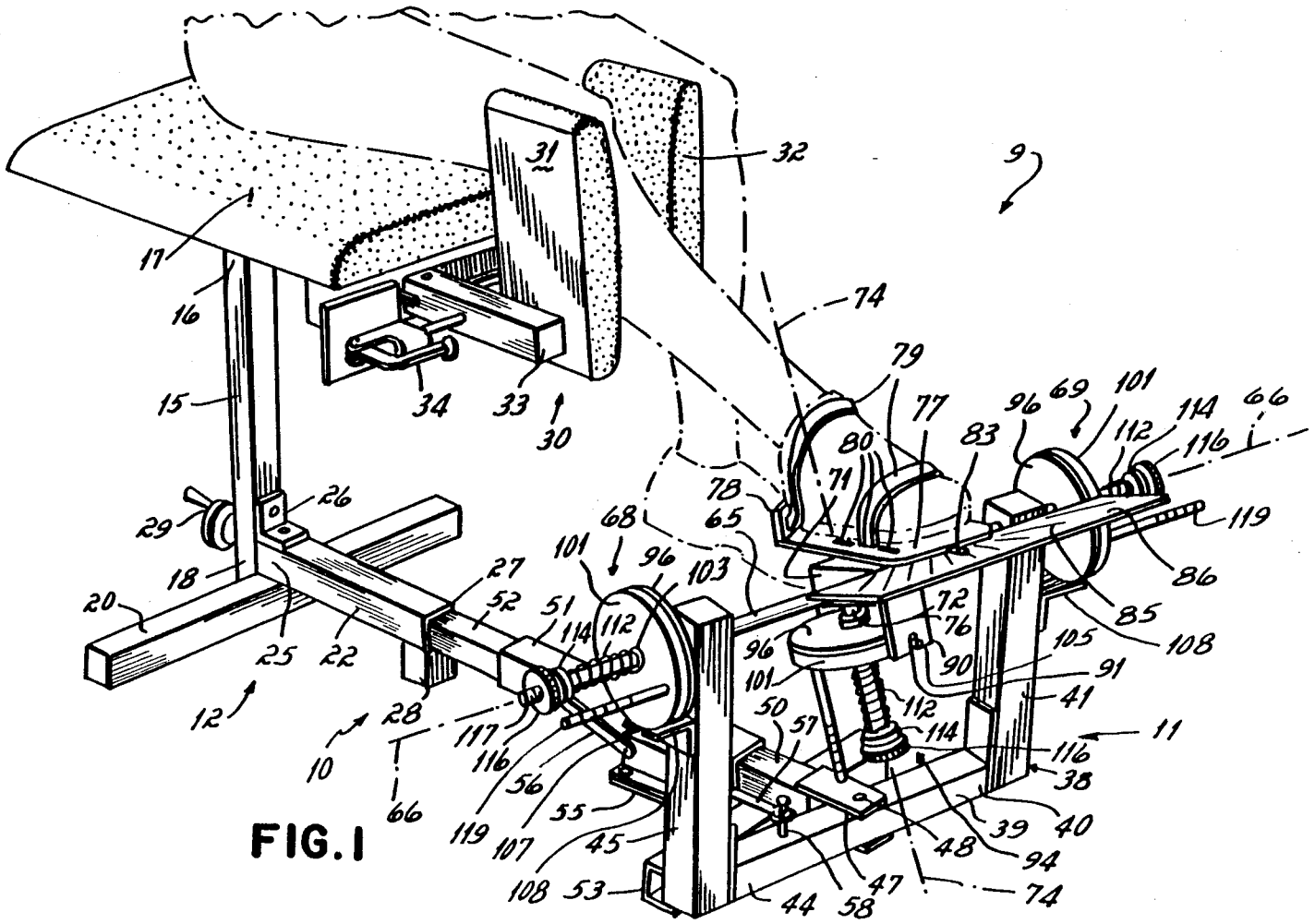
FIG. 1 is a perspective view showing one preferred embodiment of the apparatus of the invention, used for exercising the foot.

A first preferred embodiment of the invention is illustrated in FIGS. 1 through 5. Referring initially to FIG. 1, the exercise machine 9 of the invention includes a frame 10 fabricated from square steel tubing. Frame 10 comprises a front assembly 11 which extends telescopingly from a rear assembly 12.

Rear assembly 12 includes a vertical seatpost 15 whose upper end 16 supports a padded seat 17 and whose lower end 18 is welded to the center portion of a rear stabilizer 20. A forwardly extending horizontal female member 22 is welded at its rearward end 25 to rear stabilizer 20 and secured to seatpost 15 by a bracket 26. Female member 22 is supported at its forward end 27 by a short post 28. Female member 22 houses a screw mechanism (which may be of a type known per se and is not shown) for adjusting the extension of front assembly 11 by means of a crank 29 mounted on seatpost 15 opposite the rearward end 25 of female member 22.

A leg clamp 30 projects forwardly from the underside of seat 17. Leg clamp 30 comprises a padded right jaw 31 and an opposed, padded left jaw 32. Right jaw 31 is mounted to a pivot arm 33 which is connected to an over-center toggle 34 for releasably clamping the user's leg, at or just below the knee, between jaws 31 and 32. In order to accommodate users of different size, the spacing of jaws 31 and 32 can be altered by adjusting the position of left jaw 32 which is slidably secured to underside of seat 17 by a slotted bracket secured to a pair of downwardly protruding bolts by wingnuts (bracket, bolts, and wingnuts not shown).

Figures 2, 4, 5:
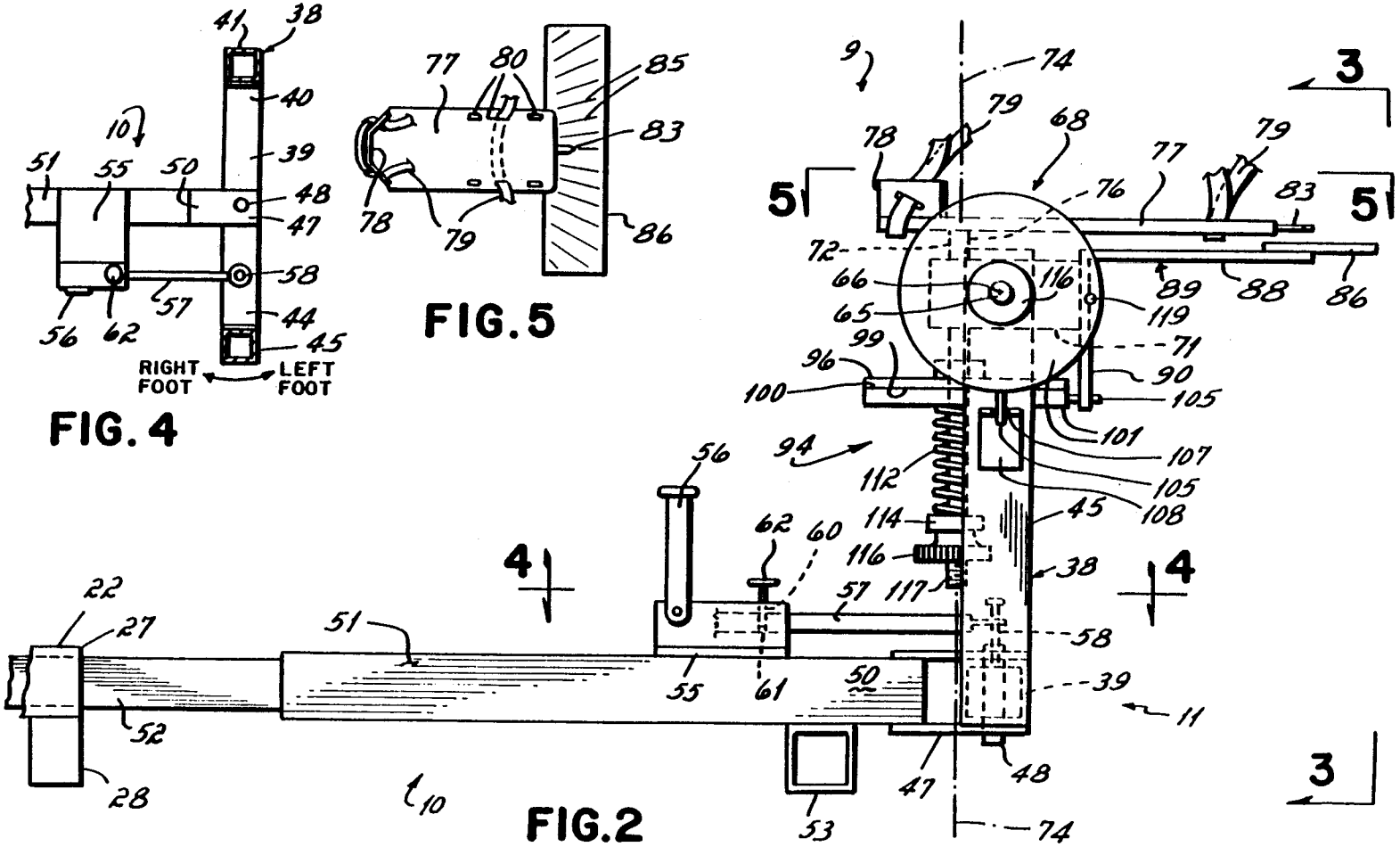
FIG. 2 is a partial side elevational view of the apparatus of FIG. 1.
FIG. 4 is a horizontal section taken on line 4—4 of FIG. 2.
FIG. 5 is a top view reduced in size, taken on line 5—5 of FIG. 2.
Figure 3:
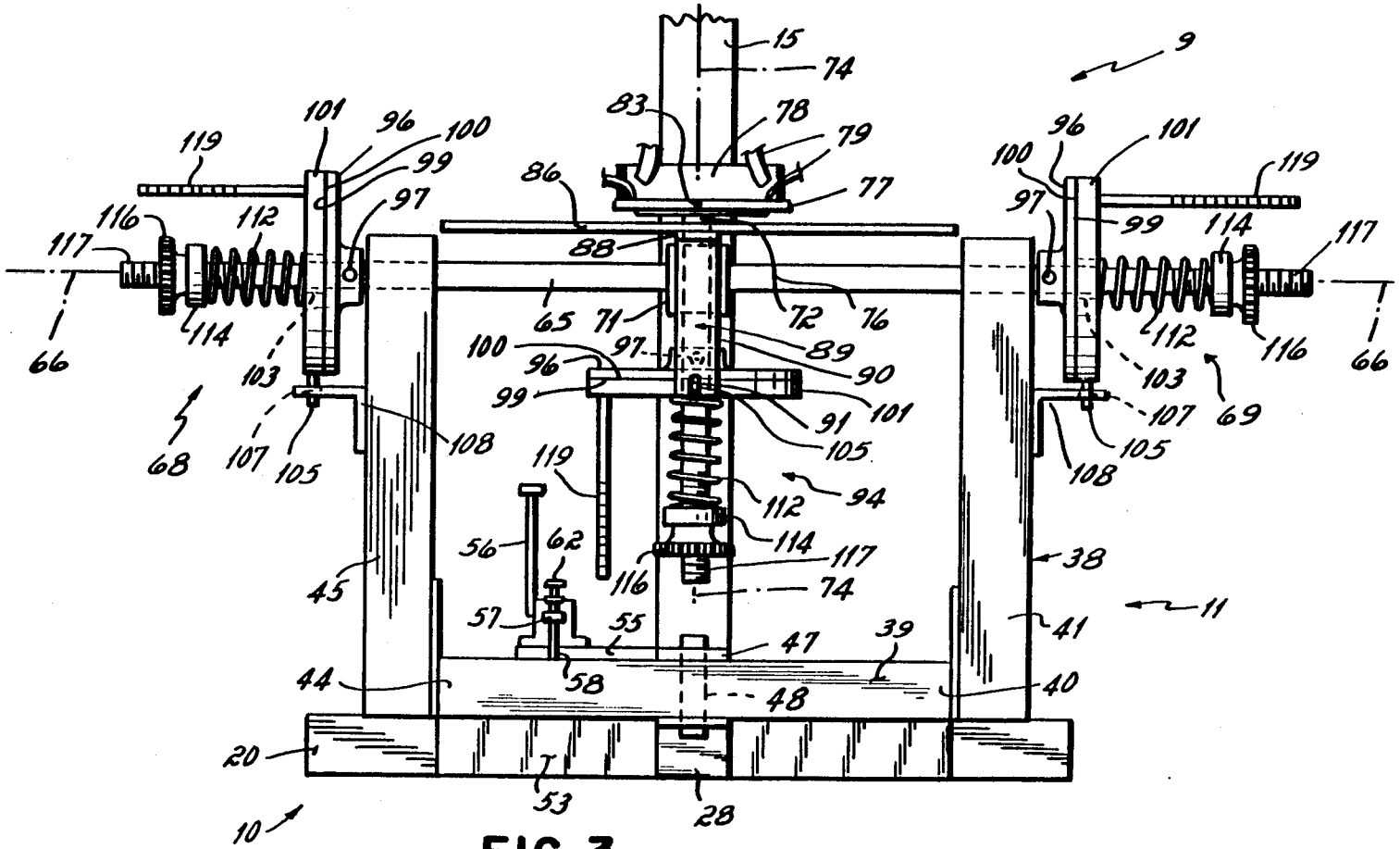
FIG. 3 is a front elevational view taken on line 3—3 of FIG. 2.

The front assembly 11 of frame 10 includes an upright, U-shaped yoke 38 having a base 39 whose left end 40 is welded to a left upright 41 and whose right end 44 is bolted (by means not shown) to a right upright 45. Yoke 38 is pivotally mounted (for rotation about a vertical axis) at the center of its base 39 by means of a clevis 47 and a large diameter, hardened pivot pin 48 to the forward end 50 of a horizontal strut 51 whose rearward end 52 is telescopingly adjustably received within the horizontal female member 22 of rear assembly 12. Front assembly 11 is supported and prevented from tipping from side to side by a front stabilizer 53 welded to horizontal strut 51. An intermediate portion of horizontal strut 51 carries a bracket 55 which supports a toggle lever 56 which is attached to the base 39 of yoke 38 by way of a connecting rod 57 pivotally secured thereto by a pin 58 at a location between its right end 44 and pivot pin 48. As best seen in FIGS. 2 and 4, bracket 55 and connecting rod 57 are provided with mating holes 60 and 61 respectively, which align when lever 56 is in a position operable to orient the base 39 of yoke 38 perpendicularly with respect to horizontal strut 51, which position may be maintained by inserting a locking pin 62 through holes 60 and 61.

A horizontal first shaft or axle 65 spans the open end of yoke 38 and is journalled within uprights 41 and 45 for rotation about a first axis 66 for plantarflexion/dorsiflexion movements of the user's foot. The ends of shaft 65 extending outside of uprights 41 and 45 carry right and left resistance assemblies 68 and 69 respectively which together determine the total torque required to rotate shaft 65 about axis 66.

At a location between the uprights 41 and 45 of yoke 38, a connector block 71 is rigidly secured to first shaft 65 for rotation therewith about first axis 66. A second shaft 72 is journalled within connector block 71 for rotation with respect thereto. Second shaft 72 is oriented along a second axis 74 which, although it does not necessarily intersect first axis 66, is oriented in a generally upright direction perpendicular thereto. The upper end 76 of second shaft 72 is rigidly connected to a footplate 77 which, for the purpose of securing the foot of the user thereto, includes a heel stop 78 and a plurality of releasable straps 79. In order to accommodate feet of various lengths, footplate 77 includes a plurality of opposed pairs of longitudinally spaced slots 80 adapted to receive at least one strap 79. The forward end of footplate 77 is provided with a pointer 83 to indicate the angle of the center line of footplate 77 with respect to second axis 74 according to angle graduations 85 marked on an angle scale in 5 degree increments. Angle scale 86 is supported by the upper portion 88 of a right-angle bracket 89, the lower portion 90 of which includes a slot 91.

The position of second shaft 72 extending below connector block 71 carries a center resistance assembly 94 which is constructed in a manner similar to right and left resistance assemblies 68 and 69. Each resistance assembly 68, 69 and 94 includes a planar rotatable friction disk 96 centered on its respective shaft 65 or 72 and secured by one or more pins or set screws 97 (FIG. 3) for rotation therewith. Each rotatable disk 96 has a friction surface 99 which mates with the friction surface 100 of a non-rotatable friction disk 101. Each non-rotatable friction disk 101 has a hole 103 through its center through which its respective shaft 65 or 72 freely passes, permitting the shaft to rotate inside disk 101. Each non-rotatable disk 101 is prevented from rotating by means of a tab 105 which projects from its edge and is fixed against rotation.

In the case of right and left resistance assemblies 68 and 69, tab 105 engages a slot 107 provided in a bracket 108 projecting from the left or right uprights 41 or 45 of yoke 38. In the case of center resistance assembly 94, tab 105 is retained within slot 91 located in the lower portion 90 of the angle bracket 89 secured to connector block 71. Frictional surfaces 99 and 100 of each resistance assembly 68, 69 and 94 are urged into mutual contact by a compression spring 112 mounted on shaft 65 or 72, respectively, between non-rotatable friction disk 101 and a thrust bearing 114. Thrust bearing 114 is retained by a torque adjustment jam nut 116 threaded onto shaft 65, 72 by means of coarse threads 117. As jam nut 116 is threadably moved along threads 117, spring 112 is compressed or lengthened to increase or decrease, respectively, the resistance to rotation provided by the resistance assembly 68, 69, 94 according to the force with which frictional surfaces 99 and 100 are urged together by spring 112. Thrust bearing 114 is interposed between jam nut 116 and spring 112 to rotationally decouple jam nut 116 from spring 112 This prevents drag of spring 112 on shaft 65, 72 from moving jam nut 116 along threads 117 and changing the torque setting unintentionally. Resistance to rotation can be gauged by means of a scale 119 extending from non-rotatable friction disk 101 in a direction parallel to its respective axis 66 or 74. Scale 119 lies adjacent jam nut 116 and may be calibrated to indicate pound-inches or other indication of torque according to the position of the outer face of jam nut 116 because the latter reflects spring compression and load on the disks.

In operation, exercise machine 9 is set up for use by first moving toggle lever 56 to orient the base 39 of yoke 38 perpendicular to horizontal strut 51 and inserting locking pin 62 through aligned holes 60 and 61 to maintain the position of yoke 38 while the extension of front assembly 11 is adjusted. With the user seated on seat 17 with one foot placed on footplate 77, so that the heel abuts heel stop 78, the extension of front assembly 11 is adjusted according to the length of the leg of the user by turning crank 29 until the user's knee is approximately centered in leg clamp 30. If necessary, the position of the left jaw 32 of leg clamp 30 is adjusted according to the width of the user's knee. Toggle 34 is then closed, causing leg clamp 30 to firmly grip the leg of the user, preferably at or below the knee. In so doing, the lower leg is at least partially isolated from the muscles of the upper body as to help insure that only the muscles of the lower leg and foot participate in the exercise. The operator then straps the user's foot securely to footplate 77, using straps 79, and adjusts right and left resistance assemblies 68 and 69 by rotating the jam nut 116 of one or both resistance assemblies 68, 69 until the resistance to rotation of the foot about first axis 66 is at a desired level for plantarflexion/dorsiflexion movement of the user's foot. Once the user's foot is strapped to footplate 77 it can be appreciated that the user's foot is restricted to move only in rotation about either first axis 66, second axis 74 or a combination of the two types of rotation. Other movements are effectively prevented. The total torque for rotation about first axis 66 is determined according to the sum of the two torque levels indicated by the scales 119 of right and left resistance assemblies 68 and 69. If inversion/eversion movements are to be performed, the trainer/therapist or other operator removes locking pin 62 and moves toggle lever 56 fully forward or backward to adjust exercise machine 9 to conform to the natural angle of the left foot or right foot, respectively, as shown in FIG. 4, according to whichever foot is strapped to footplate 77. This causes yoke 38 to shift through an angle measured in a horizontal plane, of approximately 15 degrees to compensate for the slight outward angle at which the foot normally projects from the longitudinal axis of the leg. The operator then sets center resistance assembly 94 to a desired torque by adjusting its jam nut 116 until its outer face aligns with the proper indicating mark on the torque scale 119 of the center resistance assembly 94. As noted previously, since the muscles which cause inversion/eversion movements are not normally as powerful as those controlling plantarflexion/dorsiflexion, the torque setting of center resistance assembly 94 will ordinarily be lower than the sum of the settings of right and left resistance assemblies 68 and 69. With exercise machine 9 so prepared for use, the user may exercise by rotating the foot about first axis 66 alone for plantarflexion/dorsiflexion only; about second axis 74 alone for inversion/eversion only, or about both axes 66 and 74 simultaneously for combination movements. Ordinarily, the resistance of resistance assemblies 68, 69 and 94 will be set at torque levels the user can overcome as to move footplate 77 against the resisting torque. Since resistance assemblies 68, 69 and 94 each provide substantially constant torques over the full range of rotational movement of the user's foot about axes 66 and 74, such exercise may properly be termed "isodynamic" which term means pertaining to equality of force, intensity or the like or, in this case, equality of torque. If desired, torque settings may be increased to levels the user cannot overcome, either to simply immobilize the foot about that rotational axis or to permit the user to perform isometric exercise. The term "isometric" refers to exercise wherein the muscle exerts a force but substantially no movement takes place. This occurs for example when one attempts to lift a load which is too great to overcome. Although useful, isometric exercise is considered of limited benefit for rehabilitation where exercise over a full range of movement is a key objective. Even at high torque settings along one or both axes 66 or 74, exercise machine 9 will be stable since the weight of the user on seat 17 prevents machine 9 from sliding along the floor or tipping either from side to side or front to rear when torque is applied to footplate 77.

Second Embodiment

Figure 6:
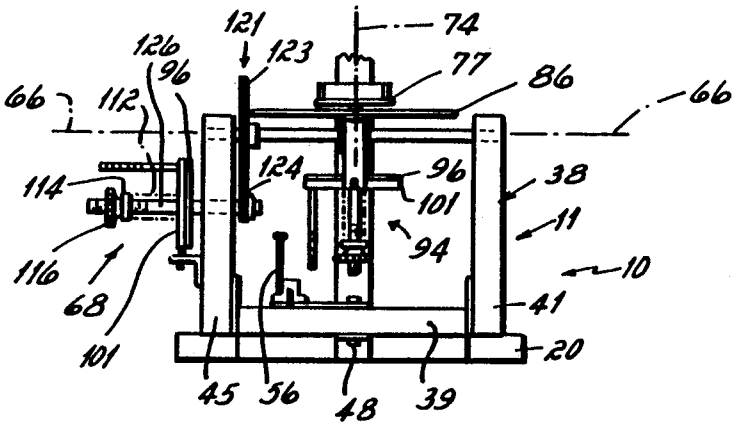
FIG. 6 is a front elevational view of a second preferred embodiment of the invention.

In light of the foregoing, a second preferred form of the exercise machine 9 of the invention may be understood with particular reference now to FIG. 6, which shows a modification of the apparatus illustrated in FIGS. 1–5 and wherein like numerals designate like parts. The embodiment illustrated in FIG. 6 is similar to the embodiment of FIGS. 1–5, except in two respects. First, although first shaft 65 is still journalled in left and right uprights 41 and 45, first shaft 65 does not extend beyond uprights 41 and 45 and left resistance assembly 69 has been omitted entirely. Secondly, right resistance assembly 68 is coupled to first shaft 65 through a gear drive assembly 121. Gear drive assembly 121 includes a first gear 123 rigidly connected to first shaft 65 for rotation therewith at a location just inside the right upright 45 of yoke 38. First gear 123 meshes with a second, smaller gear 124 which is operatively connected to the single right resistance assembly 68 through a shaft 126 journalled for rotation inside right upright 45. Gears 123 and 124 may be full circular gears or sector gears. In either case, the radius of first gear 123 is greater than the radius of second gear 124, so that the overall gear ratio of grear drive assembly 121 is at least one to two (1:2) and is preferably about one to four (1:4).

In operation, the set up and use of the apparatus of FIG. 6 is substantially the same as that of the embodiments shown in FIGS. 1–5 described earlier, except that the resistance to rotation about first axis 66 is determined by the torque setting of right resistance assembly 68 as multiplied by gear drive assembly 121, rather than by the sum of right and left resistance assemblies 68 and 69. Preferably, the calibration of the torque scale 119 in the apparatus of FIG. 6 accounts for the effect of gear drive assembly 121.

The use of gear drive assembly 121 to drive resistance assembly 68 provides a number of important advantages. First, the apparent torque at shaft 65 due to resistance assembly 68 will be multiplied by the inverse ratio of gear drive assembly 121. For an overall gear ratio of 1:4, the apparent torque at shaft 65 will be four times the torque provided by resistance assembly 68. This eliminates the need for increasing the size of the frictional surfaces 99 and 100 of disks 96 and 101, or adding an additional resistance assembly in order to supply sufficient torque to resist powerful plantarflexion/dorsiflexion movements. Secondly, rotation of footplate 77 about first axis 66 will feel smoother to the user. This is so because, for a given degree of rotation of footplate 77 about first axis 66 rotatable friction disk 96 will move through a greater angular distance than shaft 65 in accordance with the ratio to gear drive assembly 121.

Third Preferred Embodiment

Figure 7:
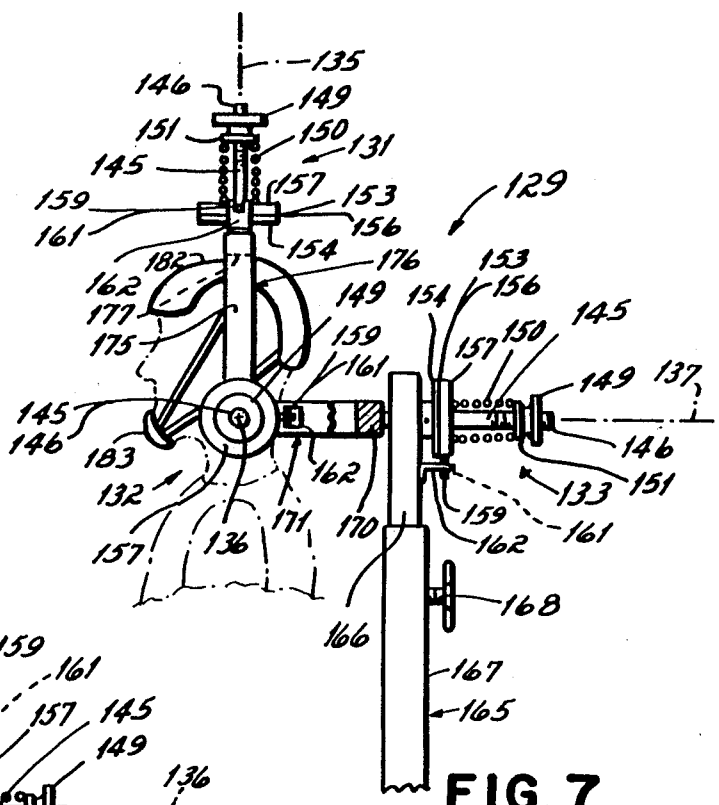
FIG. 7 is a side elevational view showing a third preferred embodiment of the invention used for exercising the neck muscles.
Figure 8:
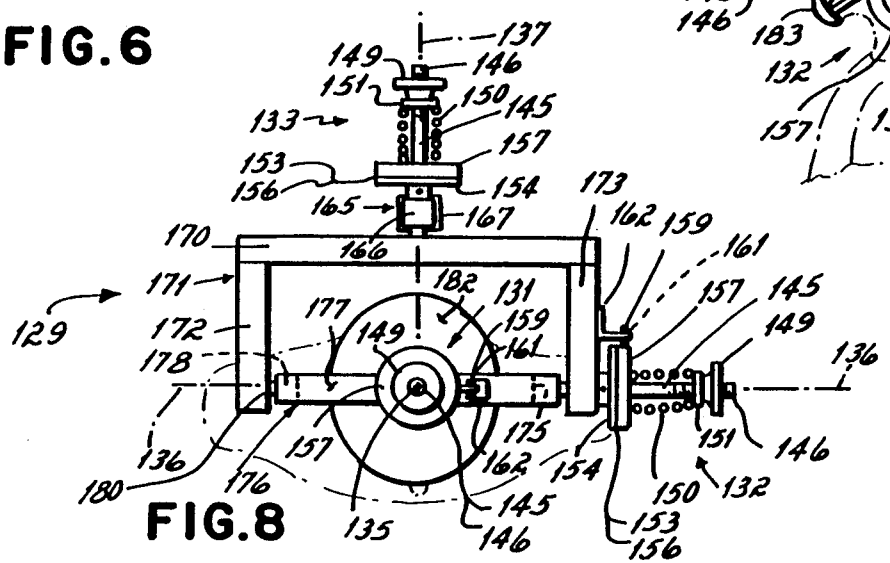
FIG. 8 is a top view of the apparatus of FIG. 7.

In light of the foregoing, a third preferred embodiment of the invention may be understood with particular reference now to FIGS. 7 and 8 which illustrate an exercise machine 129 of the invention adapted for exercising muscles associated with support and movement of the head.

Exercise machine 129 includes first, second and third adjustable resistance assemblies 131, 132 and 133 which operate to restrict movement of the head of the user to rotation about first, second and third mutually perpendicular axes 135, 136 and 137, respectively, and to apply independently adjustable torque to the head as it rotates about each axis 135, 136 and 137.

Each resistance assembly 131, 132, 133 includes a shaft 145 having coarse threads 146 on the outward end thereof upon which a knurled jam nut 149 is threaded. Jam nut 149 can be rotated to alter the length of a compression spring 150 carried on shaft 145. A thrust bearing 151 interposed between spring 150 and jam nut 149 prevents relative rotation of spring 150 and shaft 145 from moving jam nut 149 along threads 146, thereby helping to avoid inadvertent changing of the torque setting. Spring 150 urges the friction surface 153 of a non-rotatable disk 154 into contact with the friction surface 156 of a rotatable disk 154 which is connected to shaft 145 for rotation therewith. Although shaft 145 supports non-rotatable disk 145, it is not secured to shaft 145 and is prevented from rotating by means of a tab 159 projecting from the outer edge of disk 154 to engage a slot 161 in a stationary bracket 162. Alternatively, one or more of resistance assemblies 131, 132 or 133 may be driven through a gear drive assembly (not shown) constructed in a manner analogous to the embodiment of the invention illustrated in FIG. 6 described in detail above.

Exercise machine 129 further includes vertical mast 165 having an upper section 166 telescopingly received within a lower section 167 supported from a floor stand (not shown). A height adjustment bolt 168 threaded through the wall of lower section 167 is provided to lock the upper section 166 of mast 165 at a desired height. The shaft 145 of third resistance assembly 133 is oriented along third axis 137 and is journalled for rotation thereabout within the upper section 166 of mast 165. One end of the shaft 145 of third resistance assembly 133 is affixed to the center of the base 170 of a U-shaped frame 171 having a right side 172 and a left side 173, so that frame 171 is rotatable about third axis 137. The left side 173 of frame 171 carries near its open end, a second resistance assembly 132 whose shaft 145 is oriented along second axis 136 and is journalled within the left side 173 of frame 171 for rotation about second axis 136. The shaft 145 of second resistance assembly 132 is connected to the left side 175 of a narrower, second U-shaped frame 176 having a base 177 and a right side 178. The right side 178 of frame 176 is connected to the right side 172 of frame 171 through a stub shaft 180 as shown so that frame 176 can rotate about second axis 136 as well as third axis 137. Inside frame 176, a helmet 182 having a chin strap 183 for retaining the head of the user is connected to first resistance assembly 131 by way of its shaft 145 which is oriented along first axis 135 and is journalled within the base 177 of inner frame for rotation about first axis 135. Since helmet 182 is connected either directly or indirectly to each resistance assembly 131, 132 and 133, it can rotate, simultaneously, about first, second and third axes 135, 136 and 137 with the resistance to rotation about each axis being determined independently by the setting of each respective resistance assembly 131, 132 and 133.

In operation, the exercise machine 129 of this embodiment of the invention is set up for use by adjusting the height of the upper section 166 of mast 165 so that helmet 182 fits the user's head when the user sits or stands erect. Height adjustment bolt 168 is tightened to secure mast 165 at the desired height and the user's head is firmly secured to helmet 182 by fastening chin strap 183. Next, the desired resistance to rotation about each axis 135, 136 and 137 is set independently by adjusting the jam nut 149 on the shaft 145 of each respective resistance assembly 131, 132 and 133. With exercise machine 129 so prepared for use, the user may begin performing isodynamic exercise by rotating the head about any of axes 135, 136 and 137 either alone or in combination. Ordinarily resistance assemblies 131, 132 and 133 will each be set at torque levels the user can overcome to rotate the head against the resisting torques set for each axis. However, if desired, the torque settings about one or more of axes 135, 136 and 137 may be increased to levels the user cannot overcome either to immobilize the head from rotating with respect to that axis or to permit isometric exercise in that direction.

What is claimed is:

1. An apparatus for exercising muscles associated with movement of the head, comprising:

(a) movement restricting means for restricting movement of the head to rotation about a first axis, a second axis and a third axis, each of said axes lying mutually perpendicular to one another;

(b) first resistance means connected to said movement restricting means for applying an adjustable first torque to the head as it is rotated about said first axis;

(c) second resistance means connected to said movement restricting means for applying an adjustable second torque to the head as it is rotated about said second axis, and (d) third resistance means connected to said movement restricting means for applying an adjustable third torque to the head as it rotates about said third axis, said first, second, and third torques being adjustable independently of one another.

2. The apparatus of claim 1 wherein said movement restricting means permits simultaneous rotation of the head about each of said axes.

3. The apparatus of claim 1 wherein said resistance means comprises at least one friction disk.

4. The apparatus of claim 1 wherein at least one of said resistance means is a rotatable means connected to said movement restricting means through a gear train means operable to increase the apparent resistance to movement of the head.

5. The apparatus of claim 1 wherein the gear ratio of said gear train means is at least one to two.

6. An apparatus for exercising the muscles associated with movement of the foot, said foot having a natural angulation, said apparatus comprising:

(a) a frame;

(b) a first axle rotatably mounted to said frame for rotation about a first axis;

(c) first variable resistance means connected to said first axle for applying a first torque to said first axle as said first axle is rotated;

(d) a second axle connected to said first axle for rotation about a second axis, said second axle lying substantially perpendicular to said first axle;

(e) second variable resistance means connected to said second axle for applying a second torque to said second axle as said second axle is rotated, said first and said second variable resistance means being independently adjustable; and (f) a footplate connected to an end of said second axle, said footplate being rotatable simultaneously about said first axis and said second axis for transmitting said first torque and said second torque to the foot.

7. The apparatus of claim 6 further comprising adjusting means for transversely rotating said first axle to align said footplate with said natural angulation of said foot when the foot is seated on said footplate.

8. The apparatus of claim 7 wherein said adjusting means comprises a toggle lever connected to said frame.

9. The apparatus of claim 6 further comprising a seat connected to said frame to prevent said frame from moving when a person seated on said seat moves said footplate.

10. The apparatus of claim 6 further comprising releasable straps for securing the foot to said footplate.

11. The apparatus of claim 6 further comprising an indicator for providing an indication correlated to the angle of rotation of the foot about at least one of said axes.

12. The apparatus of claim 11 wherein said indicator comprises a pointer connected to said footplate and a graduated angle scale fixed relative to said axis.

13. An apparatus for exercising the muscles associated with movement of the foot, comprising:

(a) a yoke;

(b) a first axle spanning said yoke and mounted thereto for rotation about a first axis;

(c) a first friction disk connected to said first axle for applying a first torque to the first axle as said first axle is rotated;

(d) a connector block secured to said first axle for rotation therewith;

(e) a second axle journalled within said connector block for rotation about a second axis, said second axis lying perpendicular to said first axis;

(f) a second friction disk connected to said second axle for applying a second torque to said second axle as it is rotated, and (g) a footplate adapted to be secured to the foot, said footplate being rotatable simultaneously about said first axis and said second axis for transmitting said first torque and said second torque to the foot.

14. The apparatus of claim 13 further comprising axis adjusting means for adjusting said first axis of rotation to align said footplate with the angulation of the foot when the foot is seated on said footplate.

15. The apparatus of claim 14 wherein said axis adjusting means comprises a toggle lever connected to said yoke.

16. The apparatus of claim 13 further comprising a seat connected to said yoke to prevent said yoke from moving when a person seated on said seat moves said footplate.

17. The apparatus of claim 13 further comprising releasable straps for securing the foot to said footplate.

18. The apparatus of claim 13 further comprising an indicator for providing an indication correlated to the angle of rotation of the foot about at least one of said axes.

19. The apparatus of claim 18 wherein said indicator comprises a pointer connected to said footplate and a graduated angle scale fixed relative to said axis.

20. An apparatus for exercising muscles associated with movement of the foot, said foot having a natural angulation, said apparatus comprising:

(a) a frame;

(b) a first axle rotatably mounted to said frame, said first axle rotatable about a first axis;

(c) first rotation resistance means connected to said first axle;

(d) a footplate for receiving said foot and being attached to said first axle;

(e) a second axle connected to said footplate, said second axle rotatable about a second axis, said second axle being substantially perpendicular to said first axle;

(f) second rotation resistance means connected to said second axle, said first and said second rotation resistance means being independently adjustable; and (g) wherein said first axle is moveable along a horizontal plane about a vertical axis, whereby said footplate can be aligned with said natural angulation of said foot.

21. The apparatus recited in claim 20 wherein said first axle is moveable along said horizontal plane from between 0° and 15° in either direction.

22. The apparatus recited in claim 20 further comprising:

(h) a seat attached to said frame.

23. The apparatus recited in claim 22 further comprising:

(i) an adjustable leg clamp attached to said seat.

24. The apparatus recited in claim 20 wherein said frame comprises a front assembly and a rear assembly, said front and said rear assemblies being adjustably attached to one another.

25. The apparatus recited in claim 20 wherein said first rotation resistance means comprises a friction disk attached to one end of said first axle.

26. The apparatus recited in claim 25 wherein said first rotation resistance means is attached to said one end of said first axle through a gear train.

27. The apparatus recited in claim 20 wherein said first rotation resistance means comprises a friction disk attached to one end of said first axle and a friction disk attached to the other end of said first axle.

28. The apparatus recited in claim 20 further comprising adjustable straps for securing said foot to said footplate.

* * * * *